US010791604B2

(12) United States Patent
Peng

(10) Patent No.: US 10,791,604 B2
(45) Date of Patent: Sep. 29, 2020

(54) CASCADING LED LIGHTS WITH LOW POWER CONSUMPTION

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 0 days.

(21) Appl. No.: 16/526,052

(22) Filed: Jul. 30, 2019

(65) Prior Publication Data

US 2020/0214096 A1 Jul. 2, 2020

Related U.S. Application Data

(63) Continuation-in-part of application No. 16/266,819, filed on Feb. 4, 2019.

(30) Foreign Application Priority Data

Dec. 28, 2018 (CN) ..... 2018 1 1625388
Jun. 17, 2019 (CN) ..... 2019 1 0520934

(51) Int. Cl.

| | |
|---|---|
| ***H05B 37/02*** | (2006.01) |
| ***H05B 45/44*** | (2020.01) |
| ***H05B 45/00*** | (2020.01) |
| ***H05B 47/17*** | (2020.01) |
| ***H05B 47/185*** | (2020.01) |

(52) U.S. Cl.
CPC ..... *H05B 45/44* (2020.01); *H05B 45/00* (2020.01); *H05B 47/17* (2020.01); *H05B 47/185* (2020.01)

(58) Field of Classification Search
CPC ..... H05B 45/44; H05B 45/40; H05B 47/17; H05B 47/185
USPC ..... 313/307
See application file for complete search history.

(56) References Cited

U.S. PATENT DOCUMENTS 8,299,724 B2 * 10/2012 Huynh ..... H05B 45/48 315/291
8,928,233 B1 ‡ 1/2015 Peng ..... H05B 45/44 315/192
10,314,127 B2 6/2019 Zheng
(Continued)

FOREIGN PATENT DOCUMENTS

CN 101158451 A 4/2008
CN 101581412 A 11/2009
(Continued)

OTHER PUBLICATIONS

Taiwan Office Action which correspondenace to Application No. 108121180; dated Apr. 7, 2020.

*Primary Examiner* — Christopher M Raabe
(74) *Attorney, Agent, or Firm* — Muncy, Geissler, Olds & Lowe, P.C.

(57) ABSTRACT

A cascading LED lights with low power consumption includes a master light string and at least one slave light string. The master light string receives a carry light signal to control LED modules. The at least one slave light string cascades the master light string. A signal intensifier of the slave light string enhances the carry light signal to drive the LED modules. When a voltage of the carry light signal is less than a low-level voltage, the LED modules enter a low-power-consumption mode.

12 Claims, 11 Drawing Sheets

(56) References Cited

U.S. PATENT DOCUMENTS

| | | | | |
|---|---|---|---|---|
| 2007/0159422 | A1‡ | 7/2007 | Blandino | A01M 1/2077 345/82 |
| 2010/0013396 | A1* | 1/2010 | Peng | H05B 47/185 315/192 |
| 2011/0096099 | A1‡ | 4/2011 | Yamamoto | H05B 45/22 345/690 |
| 2013/0119876 | A1‡ | 5/2013 | Shin | H05B 45/46 315/186 |
| 2017/0290120 | A1‡ | 10/2017 | Peng | H05B 47/19 |
| 2018/0132314 | A1‡ | 5/2018 | Peng | H05B 33/0809 |

FOREIGN PATENT DOCUMENTS

| | | | | |
|---|---|---|---|---|
| CN | 201521844 | U ‡ | 7/2010 | F21S 4/15 |
| CN | 104981048 | A ‡ | 10/2015 | H05B 37/02 |
| CN | 105472830 | A ‡ | 4/2016 | H05B 37/02 |
| CN | 205812439 | U | 12/2016 | |
| CN | 106982489 | A ‡ | 7/2017 | H05B 33/0803 |
| TW | M312158 | | 5/2007 | |
| TW | I611727 | B ‡ | 1/2018 | H05B 33/08 |
| WO | WO2015145287 | A ‡ | 10/2015 | H05B 37/02 |

* cited by examiner
‡ imported from a related application

CASCADING LED LIGHTS WITH LOW POWER CONSUMPTION

CROSS REFERENCE TO RELATED APPLICATION

This application is a Continuation-in-Part of co-pending application Ser. No. 16/266,819, filed on Feb. 4, 2019, which claims priority to China Patent Application No. 201811625388.9, filed on Dec. 28, 2018. The entire contents of which are hereby incorporated by reference.

BACKGROUND

Technical Field

The present disclosure relates to LED lights, and more particularly to a cascading LED lights with lower power consumption.

Description of Related Art

The statements in this section merely provide background information related to the present disclosure and do not necessarily constitute prior art.

Since light-emitting diode (LED) has the advantages of high luminous efficiency, low power consumption, long life span, fast response, high reliability, etc., LEDs have been widely used in lighting fixtures or decorative lighting, such as Christmas tree lighting, lighting effects of sport shoes, etc. by connecting light bars or light strings in series, parallel, or series-parallel.

Take the festive light for example. Basically, a complete LED lamp includes an LED light string having a plurality of LEDs and a drive unit for driving the LEDs. The drive unit is electrically connected to the LED light string, and controls the LEDs by a point control manner or a synchronous manner by providing the required power and the control signal having light data to the LEDs, thereby implementing various lighting output effects and changes of the LED lamp.

With the progress of the technology, the carrier manner can be utilized for the control signal having the light data to transmit the light signal through the power line. The functions of providing power and data transmission can be achieved by the same circuit structure to simplify the layout design, reduce the volume of the circuit, and benefit the design of the control circuit.

However, if a plurality of LED light strings are cascaded in series, it causes the problem of failing to identify or incorrectly determining the data signal received by the next light strings due to the signal attenuation caused by the signal transmission of long distance light strings so that the next light strings fail to correctly display its lighting behavior, such as color change, light on/off manner, light on/off frequency, etc.

Accordingly, a quick discharge circuit can be utilized to control the light control signal to quickly reduce the voltage level of the light control signal, or the LED light string having small total parasitic capacitance easily reduces the voltage level of the light control signal quickly. However, when the light control signal quickly reduces, the light control signal easily happens that: after the light control signal is lower than the identifiable low-level voltage, the light control signal still quickly reduces so that the light control signal reaches to the reset voltage, and therefore the circuit happens unnecessary reset failure, resulting in the abnormal determination and malfunction of the LED modules.

SUMMARY

An object of the present disclosure is to provide a cascading LED lights with low power consumption to solve the above-mentioned problems.

In order to achieve the above-mentioned object, the cascading LED lights with low power consumption includes a master light string and at least one slave light string. The master light string includes an LED light string, an output control switch, and a controller. The LED light string has a plurality of LED modules. The output control switch is coupled to the LED light string. The controller is coupled to the output control switch, and receives a carry light signal and controls the output control switch to drive the LED modules. The at least one slave light string is cascaded to the master light string. Each slave light string includes an LED light string, an output control switch, and a signal intensifier. The LED light string has a plurality of LED modules. The output control switch is coupled to the LED light string. The signal intensifier is coupled to the output control switch, and receives the carry light signal and enhances the carry light signal, and controls the output control switch to drive the LED modules. When a voltage of the carry light signal is less than a low-level voltage, each of the LED modules enters a low-power-consumption mode.

In one embodiment, the master light string further includes an output connector. The output connector has a positive voltage terminal, a negative voltage terminal, and a data terminal. The slave light string further includes an input connector. The input connected has two power pins and a data pin. The two power pins are respectively coupled to the positive voltage terminal and the negative voltage terminal, and the data pin is coupled to the data terminal.

In one embodiment, the slave light string further includes an output connector. The output connected is coupled to the input connector of another slave light string.

In one embodiment, the signal intensifier includes a control switch and a signal converter and shaper. The signal converter and shaper is coupled to the control switch. When the control switch is turned on, the signal converter and shaper receives the carry light signal and enhances the carry light signal.

In one embodiment, the data terminal is coupled between the last LED module and the second last LED module.

In one embodiment, each LED module includes a voltage comparison unit. When the voltage of the carry light signal is less than the low-level voltage, the voltage comparison unit outputs a control signal to control each LED module entering a sleep state of the low-power-consumption mode.

In one embodiment, each LED module includes a current detection unit. When the voltage of the carry light signal is less than the low-level voltage, the current detection unit outputs a control signal to control each LED module entering an eco state of the low-power-consumption mode.

In one embodiment, within a time interval after entering the eco state of the low-power-consumption mode, each LED module is configured to perform the signal detection and the signal recognition; after the time interval, the control signal controls each LED module entering a sleep state of the low-power-consumption mode.

In one embodiment, each LED module further includes an oscillator. In the eco state of the low-power-consumption mode, the oscillator receives the control signal, and the oscillator is controlled by the control signal to be in an oscillation operation at low power.

In one embodiment, each LED module further includes a latch unit and an oscillator. In the eco state of the low-power-consumption mode, the latch unit and the oscillator receive the control signal, and the oscillator is controlled by the control signal to be disabled and the latch unit is controlled by the control signal to be in a timing operation.

In one embodiment, the latch unit is a charging and discharging circuit with a resistor and a capacitor.

In one embodiment, the latch unit is a timing circuit.

Accordingly, the cascading LED lights with low power consumption solve the problem of failing to identify or incorrectly determining the data signal received by the next light strings due to the signal attenuation caused by the signal transmission of long distance light strings, and by shortening the wiring distance between the data terminal and the LED light string, the control switch be driven by a sufficiently large control voltage regardless of the voltage decay affected due to the wire length so that the control switch can be normally turned on and turned off to ensure that the signal intensifier can normally operate.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWING

The present disclosure can be more fully understood by reading the following detailed description of the embodiment, with reference made to the accompanying drawings as follows.

DETAILED DESCRIPTION

Figure 1:
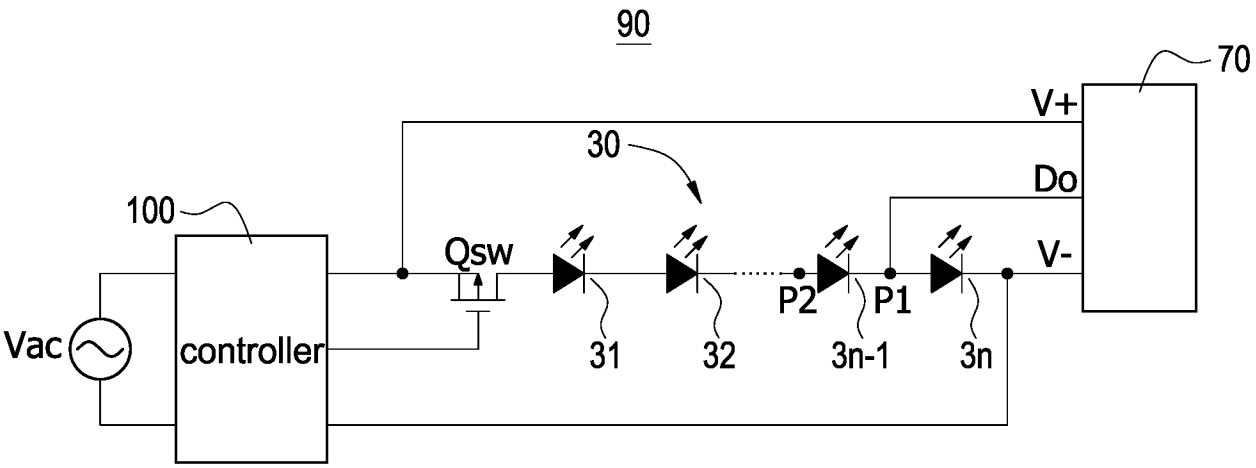
FIG. 1 is a circuit block diagram of a master light string of a cascading LED lights with low power consumption according to the present disclosure.

Reference will now be made to the drawing figures to describe the present disclosure in detail. It will be understood that the drawing figures and exemplified embodiments of present disclosure are not limited to the details thereof.

Please refer to FIG. 1, which shows a circuit block diagram of a master light string of a cascading LED lights with low power consumption according to the present disclosure. The master light string 90 of the cascading LED lights (hereinafter referred to as "master light string 90") mainly includes a controller 100, an output control switch Qsw, an LED (light-emitting diode) light string 30, and an output connector 70.

The controller 100 is coupled to an AC power Vac and the output control switch Qsw, and converts the AC power Vac to provide enough power for driving the LED light string 30 and turning on or turning off the output control switch Qsw.

The output connector 70 has a positive voltage terminal V+, a negative voltage terminal V−, and a data terminal Do. The positive voltage terminal V+ and the negative voltage terminal V− are coupled to a positive voltage and a negative voltage of a DC power converted by the controller 100, respectively. The data terminal Do receives the carry light signal (having light data and address data) for controlling light effects and changes outputted from each of a plurality of LED modules 31, 32, . . . , 3*n*. The functions of providing power and data transmission can be achieved by the same circuit structure to simplify the layout design, reduce the volume of the circuit, and benefit the design of the control circuit.

Figure 2:
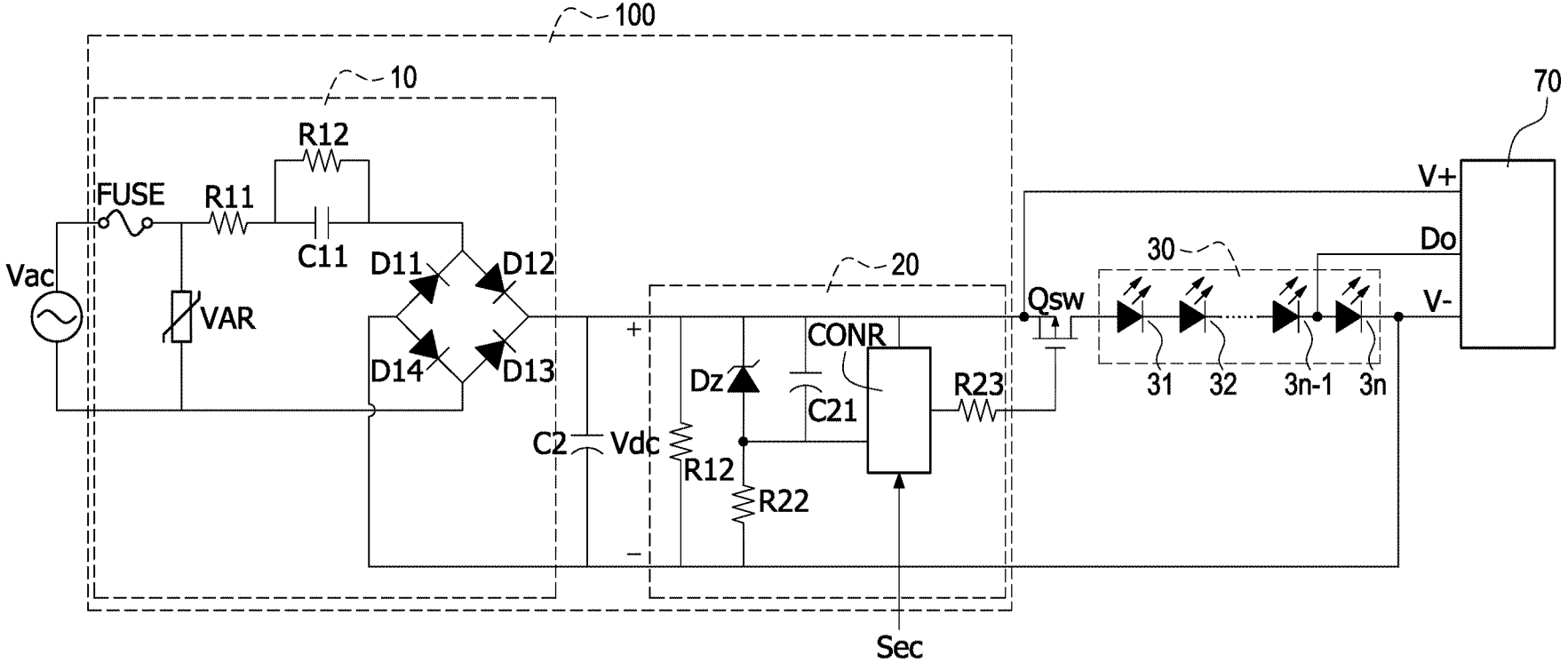
FIG. 2 is a detailed circuit diagram of the master light string of the cascading LED lights with low power consumption according to the present disclosure.

Please refer to FIG. 2, which shows a detailed circuit diagram of the master light string of the cascading LED lights with low power consumption according to the present disclosure. Specifically, FIG. 2 shows a detailed circuit diagram of the controller 100. The power conversion circuit 10 and the control circuit 20 may be integrated into a controller 100. Specifically, the controller 100 may be implemented by a physical circuit control box including the power conversion circuit 10 and the control circuit 20. The power conversion circuit 10 receives an AC power Vac and converts the AC power Vac into a DC power Vdc. The DC power Vdc is across an output capacitor (not labeled) connected at output terminals of the power conversion circuit 10.

The control circuit 20 receives the DC power Vdc to supply the required DC power for the control circuit 20 and the LED light string 30. The controller 100 is coupled to the AC power Vac and the LED light string 30 through a power line. In one embodiment, the LED light string 30 includes a plurality of LED modules 31, 32, . . . , 3*n* (also refer to the LED light). The LED modules 31, 32, . . . , 3*n* are connected in series and electrically coupled to the output control switch Qsw. In one embodiment, the LED light string 30 is a light string having data burning function, and therefore each of the LED modules 31, 32, . . . , 3*n* has own digital and analog circuits for burning light data and address data.

Figure 3:
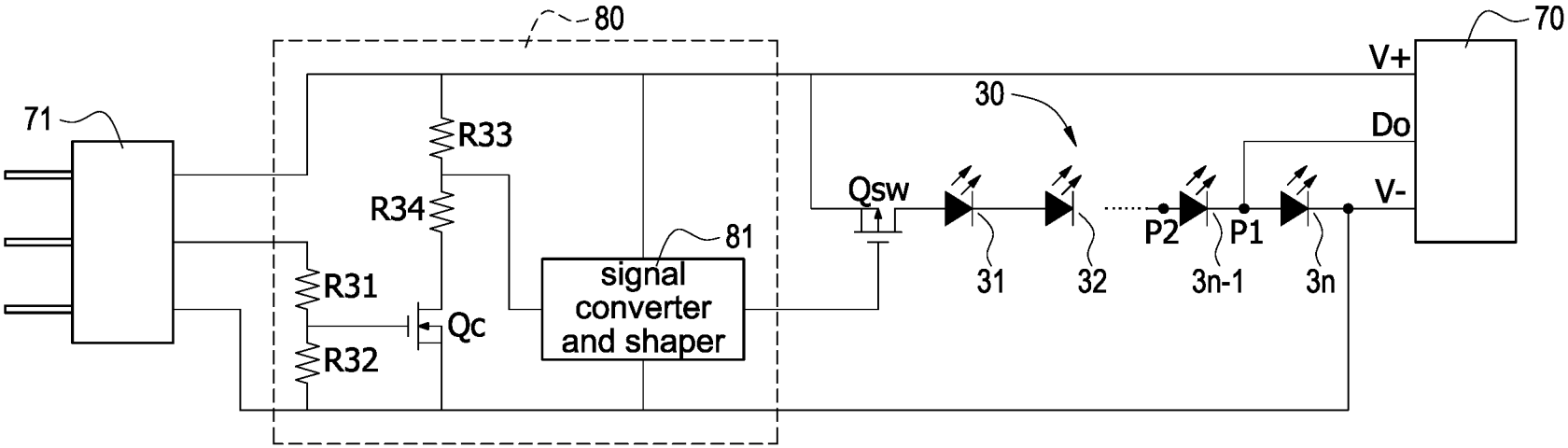
FIG. 3 is a detailed circuit diagram of a slave light string of the cascading LED lights with low power consumption according to the present disclosure.

Please refer to FIG. 3, which shows a detailed circuit diagram of a slave light string of the cascading LED lights with low power consumption according to the present disclosure. The slave light string of the cascading LED lights (hereinafter referred to as "slave light string 91") mainly includes an input connector 71, a signal intensifier 80, an output control switch Qsw, an LED light string 30, and an output connector 70. In particular, the operations of the output control switch Qsw, the LED light string 30, and the output connector 70 of the slave light string 91 is same as those of the master light string 90, and the detail description is omitted here for conciseness. The input connector 71 has three pins correspondingly to the positive voltage terminal V+, the negative voltage terminal V−, and the data terminal Do of the of the output connector 70 of the master light string 90 or the previous slave light string 91. Therefore, the three pins are correspondingly connected to the positive voltage terminal V+, the negative voltage terminal V−, and the data terminal Do when the slave light string 91 is plugged into the master light string 90 (or the previous slave light string 91), and therefore the power and the data can be transmitted to the next slave light string 91.

The signal intensifier 80 includes two voltage-divided resistor networks, a control switch Qc, and a signal converter and shaper 81. One voltage-divided resistor network is composed of resistors R31, R32, and the other voltage-divided resistor network is composed of resistors R33, R34. The resistors R31, R32 are coupled to a control end (for example a gate) of the control switch Qc, and the resistors R33, R34 are coupled to a power end (for example a drain) of the control switch Qc for operations of voltage division. Further, by turning on the control switch Qc, the signal converter and shaper 81 can convert and enhance the data signal transmitted from the previous light string to sufficiently drive the output control switch Qsw, thereby solving the problem of failing to identify or incorrectly determining the data signal received by the next light strings due to the signal attenuation caused by the signal transmission of long distance light strings. Specifically, if a voltage divided by the resistors R31, R32 is not sufficient to turn on the control switch Qc, i.e., the control switch Qc is turned off, the signal converter and shaper 81 does not receive a voltage divided by the resistors R33, R34. On the contrary, if the voltage divided by the resistors R31, R32 is sufficient to turn on the control switch Qc, the signal converter and shaper 81 receives the voltage divided by the resistors R33, R34. Therefore, the signal converter and shaper 81 can duplicate the signal waveform of the data signal transmitted from the previous light string to provide sufficient signal strength to drive turning on the output control switch Qsw.

Figure 4:
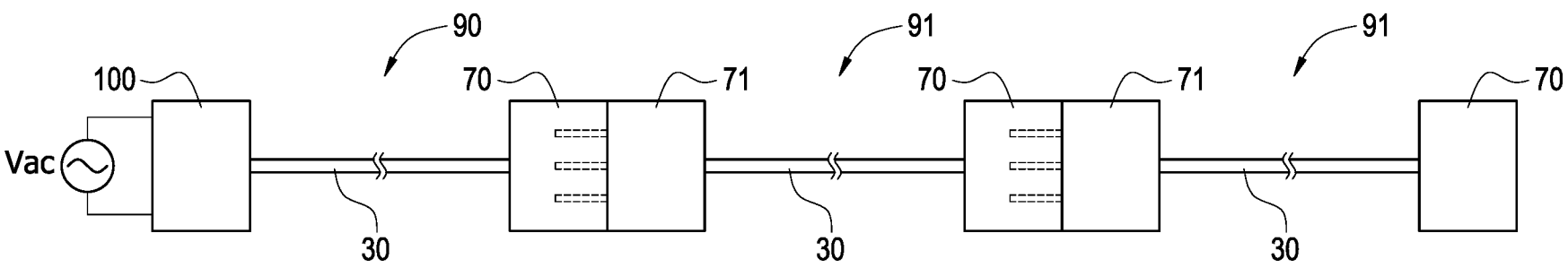
FIG. 4 is a schematic view of cascading the master light string and the slave light string according to the present disclosure.

Please refer to FIG. 4, which shows a schematic view of cascading the master light string and the slave light string according to the present disclosure. FIG. 4 shows one master light string 90 is cascaded to a plurality of slave light strings 91. That is, the input connector 71 of the first slave light string 91 is plugged into the output connector 70 of the master light string 90, and the input connector 71 of the second slave light string 91 is plugged into the output connector 70 of the first slave light string 91, and so on, thereby forming the cascading LED lights. Moreover, the signal intensifier 80 of each slave light string 91 can enhance the data signal transmitted from the previous light string so that the data signal received by the next slave light string 91 can be correctly identified. In particular, as shown in FIG. 1 (master light string 90) or FIG. 3 (slave light string 91) and take the cascaded master light string 90 and slave light string 91 for example. In order to make the control switch Qc of the signal intensifier 80 of the slave light string 91 be driven by a sufficiently large control voltage, the resistances of the resistors R31, R32 can be specially designed as well as a wiring distance between the data terminal Do and the LED light string 30 can be shortened. For example, the data terminal Do may be coupled to a contact P1 between the last LED module 3*n* and the second last LED module 3*n*-1, or the data terminal Do may be coupled to a contact P2 between the second last LED module 3*n*-1 and the third last LED module 3*n*-2. Accordingly, the control switch Qc can be driven by a sufficiently large control voltage regardless of the voltage decay affected due to the wire length so that the control switch Qc can be normally turned on and turned off to ensure that the signal intensifier 80 can normally operate.

Figure 5:
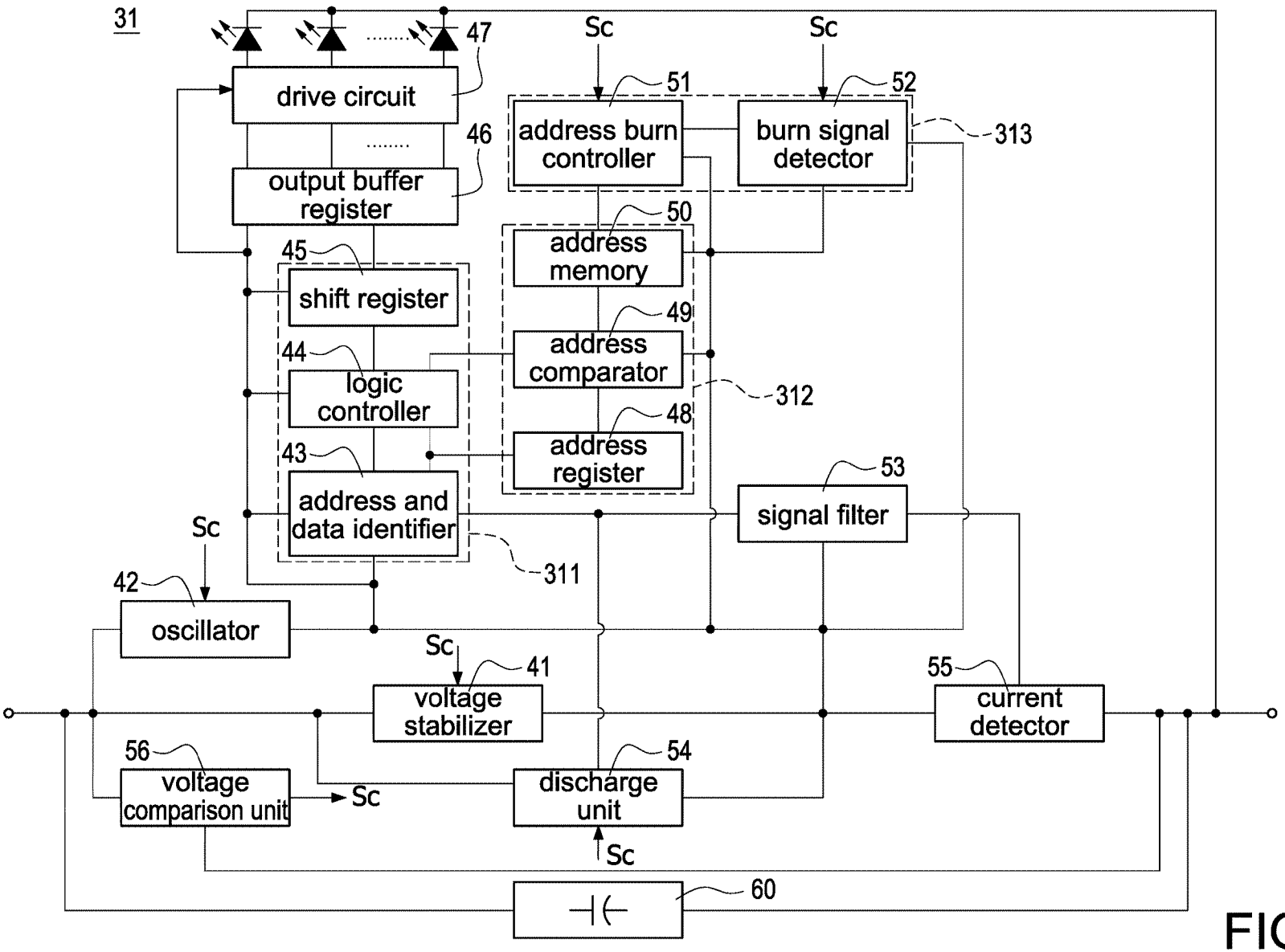
FIG. 5 is a circuit block diagram of an LED module according to a first embodiment of the present disclosure.

Please refer to FIG. 5, which shows a circuit block diagram of an LED module according to a first embodiment of the present disclosure. As mentioned above, the LED light string 30 is a light string having data burning function, and therefore each of the LED modules 31, 32, . . . , 3*n* has own digital and analog circuits for burning light data and address data. For example, a light control unit 311 is responsible for controlling illumination, an address signal process unit 312 is responsible for processing address signal, and an addressing burn unit 313 is responsible for burning address. Take the LED module 31 shown in FIG. 5 for example, and the remaining LED modules 32, . . . , 3*n* have the same circuit topologies and will not be described again. The LED module 31, i.e., the LED light includes a voltage stabilizer 41, an oscillator 42, an address and data identifier 43, a logic controller 44, a shift register 45, an output buffer register 46, a drive circuit 47, an address register 48, an address comparator 49, an address memory 50, an address burn controller 51, a burn signal detector 52, a signal filter 53, a discharge unit 54, a current detector 55, and a voltage comparison unit 56.

Since the LED module 31 shown in FIG. 5 is applied to the in-series connection, the voltage stabilizer 41 is necessary for voltage regulation and voltage stabilization. Since the LED module 31 shown in FIG. 5 operates by a point control manner, the LED module 31 includes the address signal process unit 312 and the addressing burn unit 313 for processing (including determining, memorizing, burning, etc.,) address data. That is, the address register 48, the address comparator 49, the address memory 50, the address burn controller 51, the burn signal detector 52 are involved. In other words, if the LED module 31 operates by a synchronous control, the address signal process unit 312 and the addressing burn unit 313 can be omitted, that is, only the light control unit 311 with processing light data is necessary.

In the above circuit, the difference in signal characteristics can be divided into analog circuits and digital circuits. The voltage stabilizer 41, the oscillator 42, the address burn controller 51, the burn signal detector 52, and the discharge unit 54 belong to the analog circuits, and others belong to the digital circuits. In different embodiments, however, the address burn controller 51 and the burn signal detector 52 may be implemented by both the analog circuit and the digital circuit. In comparison with the low power consumption of the digital circuits, the analog circuits, including the voltage stabilizer 41, the oscillator 42, the light control unit 311, the address signal process unit 312, the addressing burn unit 313, and the discharge unit 54 are the circuit components with relatively high power consumption of the LED module 31.

Figure 6:
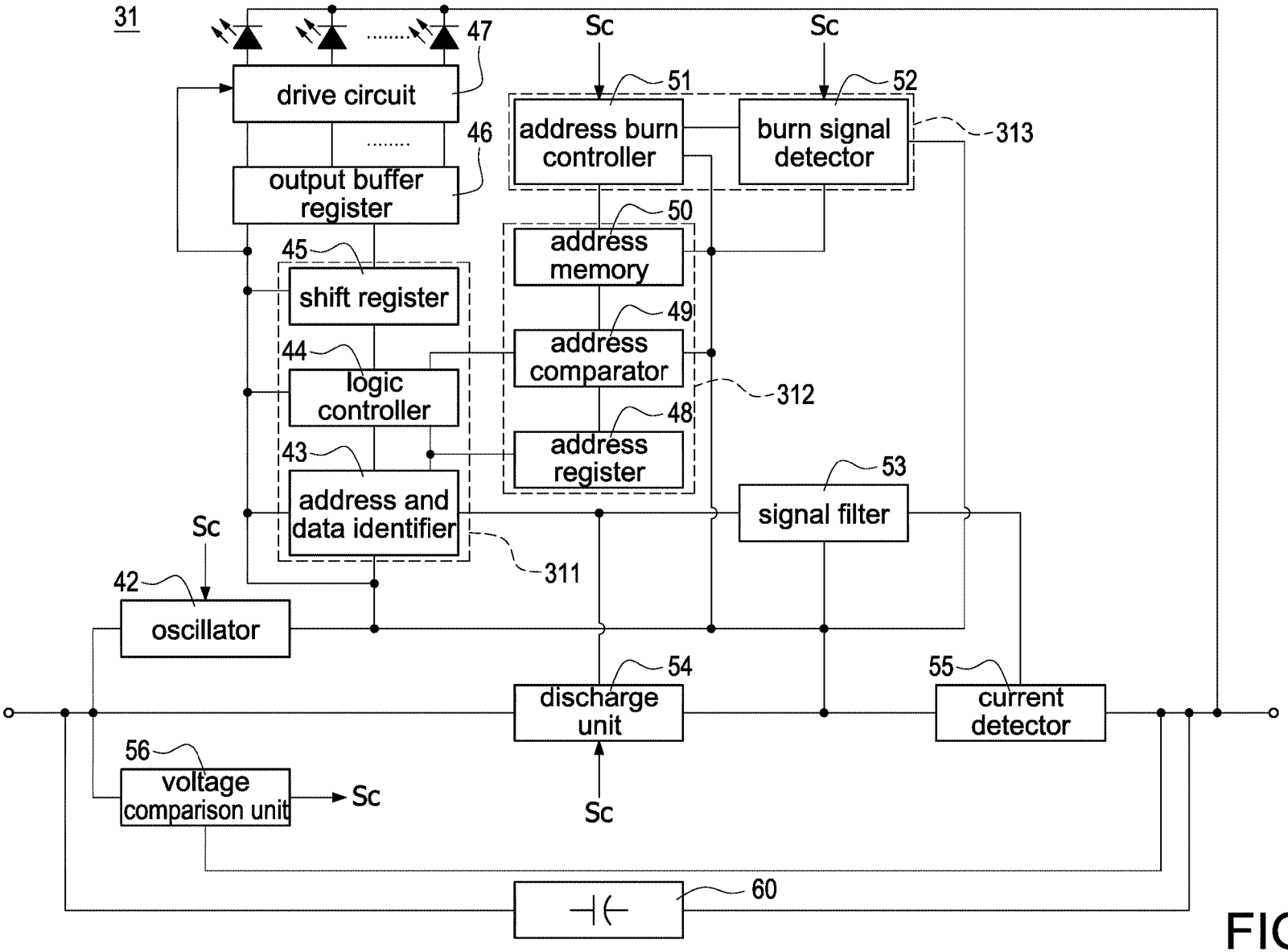
FIG. 6 is a circuit block diagram of the LED module according to a second embodiment of the present disclosure.

Please refer to FIG. 6, which shows a circuit block diagram of the LED module according to a second embodiment of the present disclosure. As mentioned above, since the LED module shown in FIG. 6 is applied to the in-parallel connection, the voltage stabilizer 41 is unnecessary for voltage regulation and voltage stabilization. The operations of the remaining circuits are the same in FIG. 5, and the detail description is omitted here for conciseness.

In order to effectively reduce the power consumption of the analog circuits and normally operate the LED module 31, the LED module further includes a voltage comparison unit 56 for voltage comparison. Take a voltage signal as the light drive signal for example, the voltage comparison unit 56 receives the light drive signal Vd and a predetermined reference voltage value Vth. Please refer to FIG. 7, in this embodiment, the voltage comparison unit 56 is implemented by an operational amplifier. A non-inverting input end of the voltage comparison unit 56 receives the light drive signal Vd and an inverting input end of the voltage comparison unit 56 receives the reference voltage value Vth, and the voltage comparison unit 56 compares the light drive signal Vd with the reference voltage value Vth. If the light drive signal Vd is greater than the reference voltage value Vth, the voltage comparison unit 56 outputs a high-level control signal Sc. On the contrary, if the light drive signal Vd is less than the reference voltage value Vth, the voltage comparison unit 56 outputs a low-level control signal Sc. However, this is not a limitation to this present disclosure. The inverting input end may receive the light drive signal Vd and the non-inverting input end may receive the reference voltage value Vth, and the control signal Sc with the opposite level can be acquired after the voltage comparison unit 56 compares the light drive signal Vd with the reference voltage value Vth. Similarly, the determination of the light drive signal Vd can be achieved. Further, the determination of the light drive signal Vd can be implemented without limitation using an operational amplifier circuit, and any circuit usable for voltage comparison should be included in the scope of the present invention.

Figure 8:
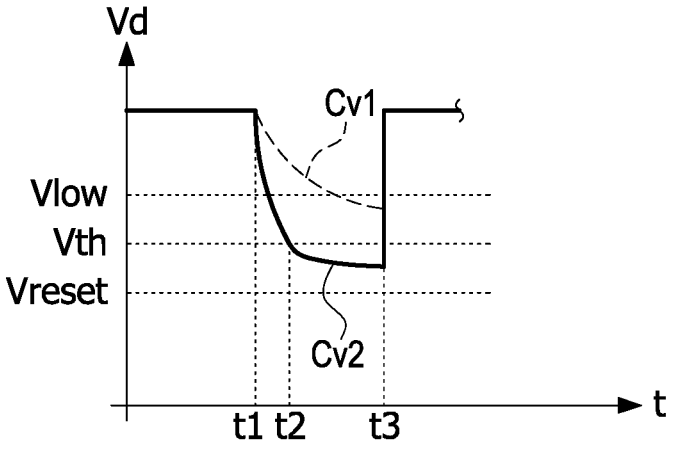
FIG. 8 is a schematic waveform of a light drive signal according to the present disclosure.

Please refer to FIG. 8, which shows a schematic waveform of a light drive signal according to the present disclosure. As mentioned above, when the control unit CONR turns off the output control switch Qsw, the voltage outputted from the LED light string 30 is reduced by the discharging manner so as to provide a low-level voltage of a light drive signal Vd for each of the LED modules 31, 32, . . . , 3*n* of the LED light string 30. Alternatively, the quick discharging circuit (not shown) inside each of the LED modules 31, 32, . . . , 3*n* is controlled to quickly reduce the voltage generated from a light signal voltage generation circuit to provide the low-level voltage of the light drive signal Vd for each of the LED modules 31, 32, . . . , 3*n* of the LED light string 30. Moreover, by comparing the light drive signal Vd with the reference voltage value Vth by the voltage comparison unit 56, it is to avoid unnecessary reset failure of the circuits to cause determination abnormality and malfunction of the LED module 31 since the light drive signal Vd quickly reduces to reach to the reset voltage Vreset during the quick discharging operation.

Figure 7:
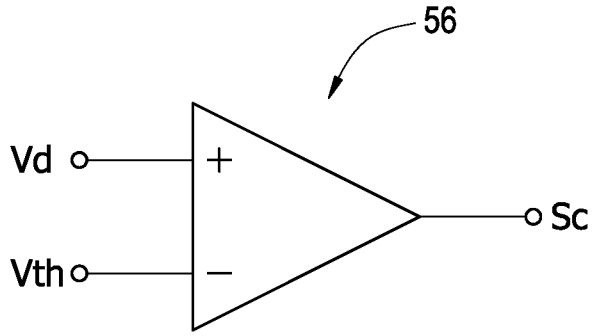
FIG. 7 is a circuit diagram of a voltage comparison unit according to the present disclosure.

Specifically, as shown in a second waveform Cv2. At a time point t1, the output control switch Qsw is controlled to be turned off by the control unit CONR. At this condition, the light drive signal Vd quickly reduces. At the time point t12, when the light drive signal Vd reaches to the reference voltage value Vth, the voltage comparison unit 56 shown in FIG. 7 compares two voltages and outputs the control signal Sc with the low level since the light drive signal Vd is less than (or less than or equal to) the reference voltage value Vth, thereby avoiding the light drive signal Vd further quickly reducing. The control signal Sc produced from the voltage comparison unit 56 is to control, for example but not limited to, the analog circuits with higher power consumption in the LED module 31. As shown in FIG. 5, when the voltage stabilizer 41, the oscillator 42, the light control unit 311, the address signal process unit 312, the addressing burn unit 313, and the discharge unit 54 enter a sleep mode or an eco mode, thereby significantly reducing the power consumption of the LED module 31 to slow the reduction speed of the light drive signal Vd. Incidentally, in order to simplify the FIG. 5 and FIG. 6, the control signal Sc inputting to the voltage stabilizer 41, the oscillator 42, the address burn controller 51, the burn signal detector 52, and the discharge unit 54 is actually from the voltage comparison unit 56 coupled to the voltage stabilizer 41, the oscillator 42, the address burn controller 51, the burn signal detector 52, and the discharge unit 54 respectively, and the voltage comparison unit 56 provides the control signal Sc to the circuit units.

After the time point t2 shown in FIG. 8, when the light drive signal Vd is less than the reference voltage value Vth, since the above-mentioned analog circuits enter the sleep mode, the reduction speed of the light drive signal Vd slows down to avoid reaching to the reset voltage Vreset. Incidentally, quick discharge detection, effectively reducing power consumption, and correctly determining (identifying) the low level voltage of the light drive signal Vd can be achieved by designing that the low level voltage for identifying the light drive signal Vd is the reference voltage value Vth, or is slightly less than the reference voltage value Vth but is greater than the voltage value of the reset voltage Vreset, and therefore the LED module 31 can be normally driven and can normally operate. For example, the reset voltage Vreset may be designed as 0.7 volts, the reference voltage value Vth may be designed as 1.1 volts, and the low-level voltage of the light drive signal Vd may be designed as 1.1 volts (or smaller 0.8 to 1.0 volt). Cooperating with the requirement of the response or the action of the whole circuit, the present disclosure can properly design and adjust the reset voltage Vreset, the reference voltage value Vth, and the low-level voltage of the light drive signal Vd.

Until a time point t3, the control unit CONR turns on the output control switch Qsw to restore (increase) the output voltage outputted to the LED light string 30, and produces the light drive signal Vd according to the light control data Sec received by the control unit CONR so that the LED light string 30 proceeds the operation of the light mode according to the light drive signal Vd. Therefore, since the light drive signal Vd is greater than the reference voltage value Vth, the control signal Sc produced by the voltage comparison unit 56 is transited from the low level to the high level so that the control signal Sc controls the voltage stabilizer 41, the oscillator 42, the light control unit 311, the address signal process unit 312, the address burn unit 313 and the discharge unit 54 to leave the sleep mode and to restore the normal operations of the circuit units. Similarly, the remaining LED modules 32, . . . , 3*n* are controlled by the subsequent cycles of the light drive signal Vd, and the detail description is omitted here for conciseness. Therefore, the operations of driving and controlling all the LED modules 31, 32, . . . , 3*n* of the LED light string 30 are accomplished.

Figure 9:
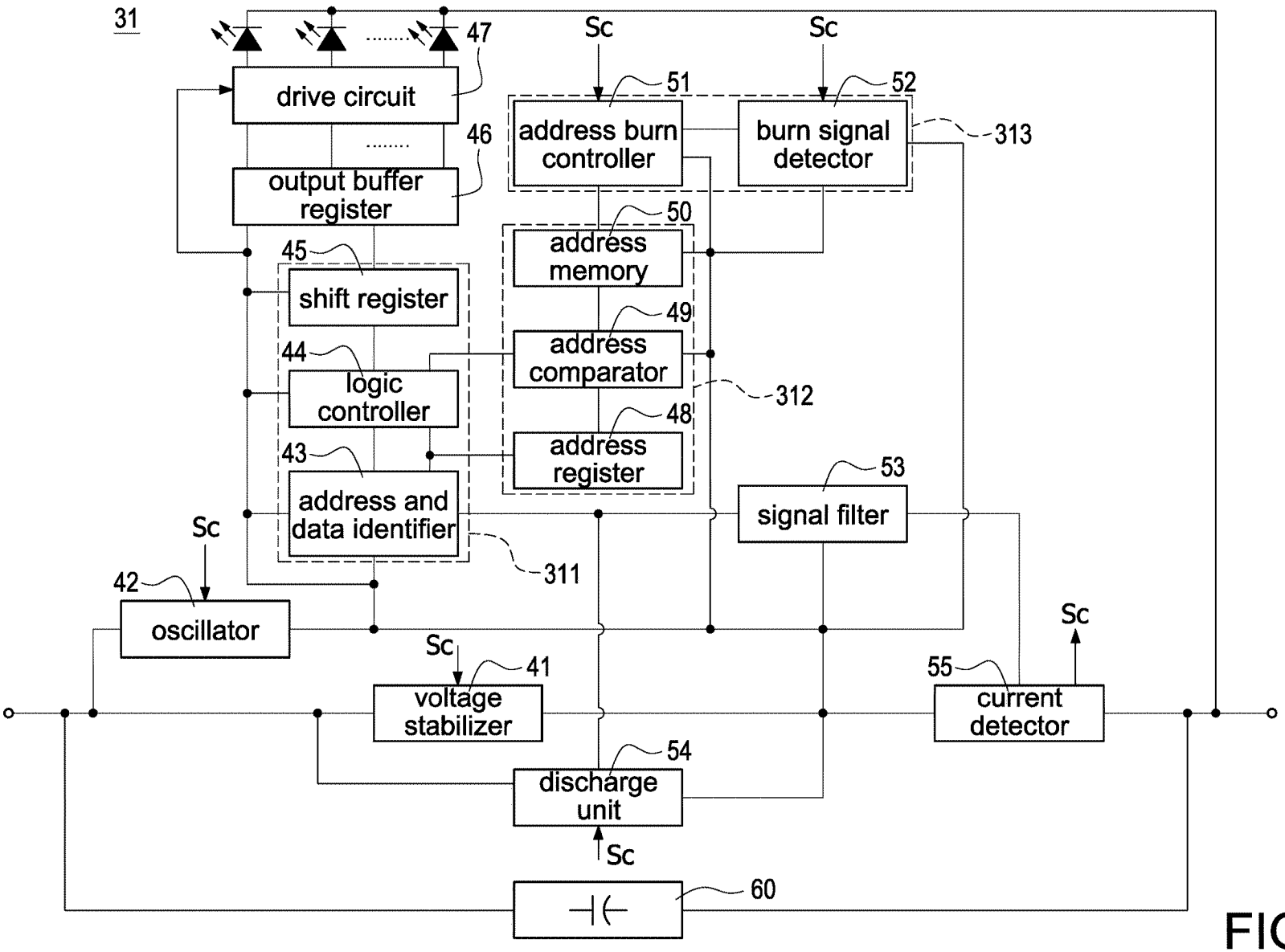
FIG. 9 is a circuit block diagram of the LED module according to a third embodiment of the present disclosure.

Please refer to FIG. 9, which shows a circuit block diagram of the LED module according to a third embodiment of the present disclosure. In comparison with FIG. 5, since the control signal Sc is produced by the current detector 55 instead of the voltage comparison unit 56, the absence of the voltage comparison unit 56 is illustrated in the third embodiment. Please refer to FIG. 11, when the control unit CONR turns off the output control switch Qsw, the voltage outputted from the LED light string 30 is reduced by the discharging manner so as to provide a low-level voltage of a light drive signal Vd for each of the LED modules 31, 32, . . . , 3*n* of the LED light string 30. Alternatively, the quick discharging circuit (not shown) inside each of the LED modules 31, 32, . . . , 3*n* is controlled to quickly reduce the voltage generated from a light signal voltage generation circuit to provide the low-level voltage of the light drive signal Vd for each of the LED modules 31, 32, . . . , 3*n* of the LED light string 30. In particular, three modes are provided to control the LED modules 31, 32, . . . , 3*n* in the present disclosure. The first mode is a work mode, the second mode is an eco mode, and the third mode is a sleep mode. Therefore, the LED modules 31, 32, . . . , 3*n* can normally operate and meet the requirement of low power consumption.

The work mode means that internal circuits, including analog circuits and digital circuits in each of the LED modules 31, 32, . . . , 3*n* can normally operate. In order to achieve the purpose of low power consumption, the eco mode first operates, and then the sleep mode operates. The purpose of the eco mode is to first turn off (disable) the analog circuits with higher power consumption. The cooperation consideration between the oscillator and the digital circuits is necessary, however, the analog circuits except the oscillator or the analog circuits involving the oscillator are first turned off (disabled) in the eco mode to significantly reduce more power consumption and maintain the normal operation of the digital circuits, and therefore signal detection and signal recognition can normally work. In the eco mode, the oscillator is controlled to be in an oscillation operation at low power without turning off. After the signal detection and signal recognition is completed, the oscillator is turned off to enter the sleep mode. Accordingly, it is to avoid unnecessary reset failure of the circuits to cause determination abnormality and malfunction of the LED module 31 since the light drive signal Vd quickly reduces to reach to the reset voltage Vreset during the quick discharging operation.

Figure 11:
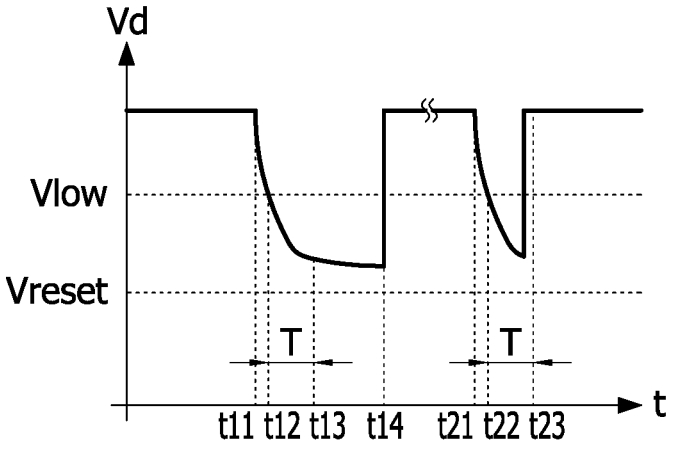
FIG. 11 is a schematic waveform of a light drive signal according to the present disclosure.

Specifically, as shown in FIG. 11. Before the time point t11, the output control switch Qsw is controlled to be turned on by the control unit CONR, and therefore each of the LED modules 31, 32, . . . , 3*n* is in the work mode. At the time point t11, the output control switch Qsw is controlled to be turned off by the control unit CONR. At this condition, the light drive signal Vd quickly reduces. At the time point t12, the light drive signal Vd reaches to the low-level voltage Vlow so as to identify that the light drive signal Vd is a proper drive signal for driving the LED modules 31, 32, . . . , 3*n* (the following description is based on the LED module 31). However, in order to avoid unnecessary reset failure of the circuits to cause determination abnormality and malfunction of the LED module 31 since the light drive signal Vd gradually reduces to reach to the reset voltage Vreset, it is to enter the eco mode at the time point t12. The analog circuits except the oscillator or the analog circuits involving the oscillator are first turned off (disabled) to significantly reduce more power consumption. Moreover, in order to maintain the normal operation of the digital circuits and the oscillator, the signal detection and signal recognition must be completed within a time interval T, and then it is to enter the sleep mode at the time point t13, thereby significantly reducing power consumption of the LED module 31. The time interval T means a time interval between the time point t12 and the time point t13, for example but not limited to, a time length of several (3 or 4) clock cycles. Therefore, after the time point t13, the oscillator is completely turned off so that the power consumption of the LED module 31 is minimized. Accordingly, it is not only to optimize the low power consumption but also to avoid causing abnormal conditions since the light drive signal Vd reduces to reach to the reset voltage Vreset. At the time point t14, the output control switch Qsw is controlled to be turned on by the control unit CONR, and therefore the voltage level of the light drive signal Vd is restored. At this condition, since the voltage level of the light drive signal Vd is greater than the low-level voltage Vlow, it is to leave the sleep mode and enter the work mode again in the next cycle.

FIG. 11 further shows the light drive signal Vd with a narrow-width cycle, for example but not limited to 1 microsecond. In comparison with the narrow-width cycle, a wide-width cycle between the time point t11 and the time point t14 is about 3 microseconds. The difference between the narrow-width cycle and the wide-width cycle is that the voltage level of the light drive signal Vd is restored before the time interval T has ended (i.e., before entering the sleep mode) in the former. At this condition, since the output control switch Qsw is controlled to be turned on by the control unit CONR, the voltage level of the light drive signal Vd is restored to enter the work mode again, thereby avoiding causing abnormal conditions since the light drive signal Vd reduces to reach to the reset voltage Vreset.

Therefore, the features of the present disclosure focus on both effectively reducing the power consumption of the analog circuits in the eco mode and the sleep mode and normally operating the LED module 31, and the detail description can be referred to FIG. 5 and is omitted here for conciseness.

Figure 10:
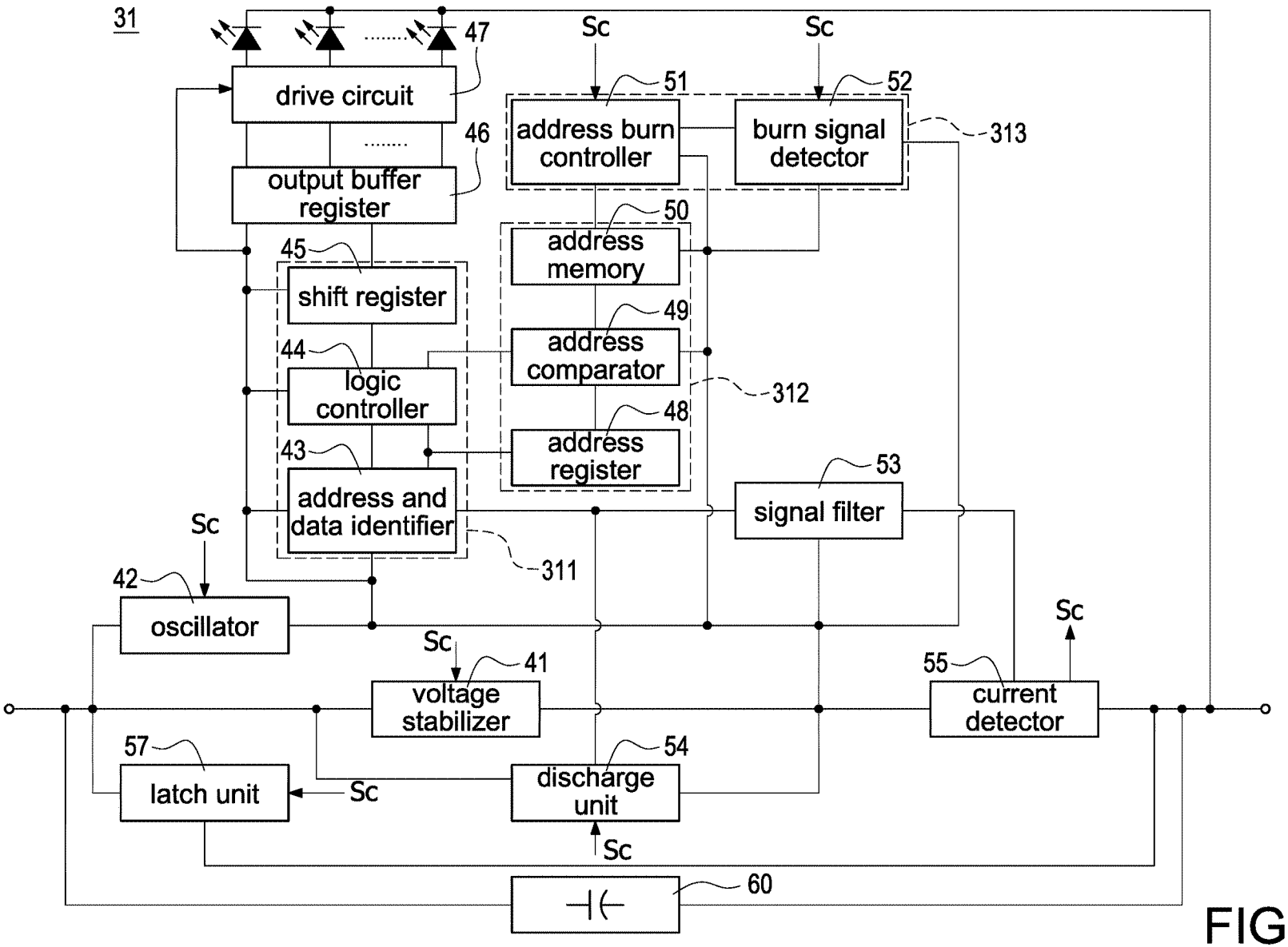
FIG. 10 is a circuit block diagram of the LED module according to a fourth embodiment of the present disclosure.

Please refer to FIG. 10, which shows a circuit block diagram of the LED module according to a fourth embodiment of the present disclosure. In comparison with the third embodiment shown in FIG. 9, the LED module 31 further includes a latch unit 57, the remaining circuits are the same in FIG. 9. The latch unit 57 is coupled between an input side and an output side inside the LED module 31. The latch unit 57 is used to replace the oscillator 42 in the sleep mode so that the LED module 31 can continuously perform the signal detection and signal recognition. In one embodiment, the latch unit 57 may be an analog charging and discharging circuit composed of a resistor and a capacitor.

Hereinafter, a description will be given of how the present disclosure achieves reducing power consumption and saving energy. Please refer to FIG. 11, when the light drive signal Vd reaches to the low-level voltage Vlow (at the time point t12 or time point t22 shown in FIG. 11), the current detector 55 produces the control signal Sc. At this condition, the analog circuit with relatively high power consumption of the LED module 31 such as the voltage stabilizer 41, the oscillator 42, the address burn controller 51, the burn signal detector 52, and the discharge unit 54 are controlled by the control signal Sc to enter the eco mode, thereby reducing the main source of power consumption. The eco mode can be regarded as a first stage control mode to reduce power consumption. However, since the operation of the digital circuits is closely related to the oscillator 42 and in order to ensure that the digital circuit can perform its necessary operation, the oscillator 42 is then controlled to enter to the sleep, which can be regarded as a second stage control mode to reduce power consumption. Specifically, two embodiments are proposed to reduce the power consumption of the oscillator 42 in the eco mode. The first one is that the oscillator 42 is controlled to be in an oscillation operation at low power without turning off, and the second one is that the oscillator 42 is replaced by the charging and discharging circuit.

Figure 12:
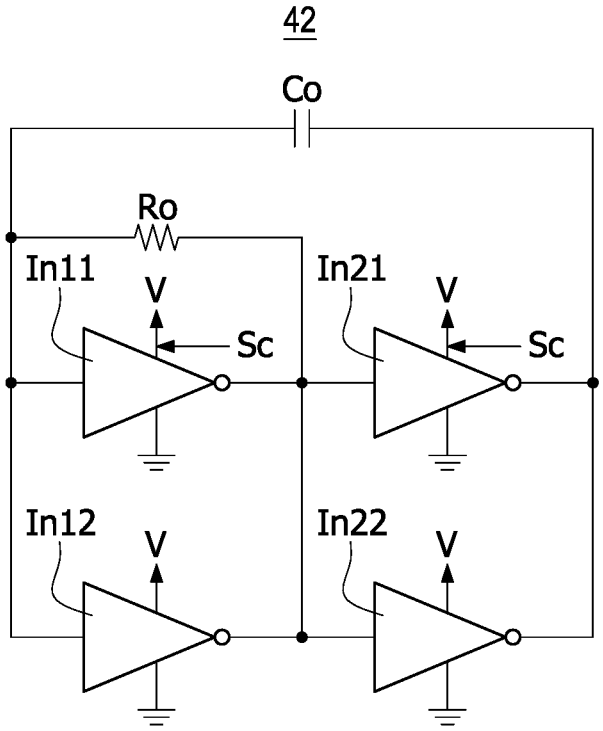
FIG. 12 is a schematic circuit diagram of an oscillator according to the present disclosure.

Please refer to FIG. 12, which shows a schematic circuit diagram of an oscillator according to the present disclosure, and also refer to FIG. 9. In terms of control accuracy, the best manner is to use the oscillator 42 to produce the periodic clock signal as the time reference. However, in order to have requirements of accurate control and low-power consumption, the specific design of the oscillator 42 is provided to implement the low-power oscillation in a first embodiment. The oscillator 42 shown in FIG. 12 includes a plurality of inverters In11-In22, a resistor Ro, and a capacitor Co. However, the connection thereof is for illustrative purposes only, and is not intended to limit the present disclosure. The inverters In11-In22 are CMOS transistor circuit inverters. The design of different transistor sizes and the control of enabling and disabling are implemented to achieve the accurate control and low power consumption. For example, but not limited to that the size of the inverter In12 and the size of the inverter In22 are smaller than that of the inverter In11 and that of the inverter In21, respectively. Further, the inverter In11 and the inverter In21 are controlled by the control signal Sc.

When the oscillator 42 normally operates, i.e., the LED module 31 is in the work mode (before the time point t12 shown in FIG. 11), the inverters In11-In22 are enabled. At this condition, the oscillator 42 operates at a full-power condition to provide a clock signal. When the light drive signal Vd reaches to the low-level voltage Vlow (at the time point t12 shown in FIG. 11), the control signal Sc produced from the current detector 55 controls the inverter In11 and the inverter In21 to be disabled, at this condition, the inverter In12 and the inverter In22 are still enabled. Alternatively, the inverter In12 and inverter In22 may be controlled by the control signal Sc to be disabled, but the inverter In11 and the inverter In21 are still enabled. Accordingly, the oscillator 42 can be controlled by the control signal Sc to be in an oscillation operation at low power, thereby ensuring that the digital circuit can perform its necessary operation and implementing the lower power consumption of the oscillator 42. Until the LED module 31 completes the signal detection and signal recognition within the time interval T between the time point t12 and the time point t13 shown in FIG. 11, the oscillator 42 is turned off to enter to the sleep mode after the time point t13. However, the connection relationship, the number, the size, and the signal control manner of the inverters In11-In22 are for illustrative purposes only and are not intended to limit the present disclosure.

Figure 13:
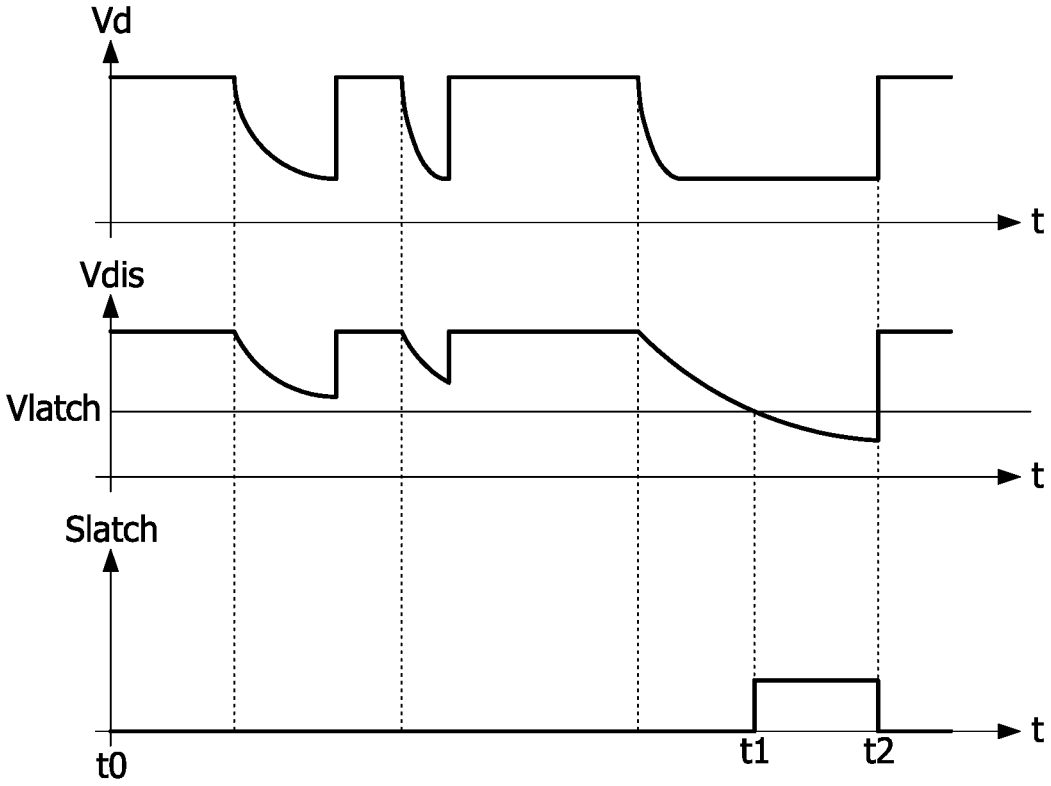
FIG. 13 is a schematic waveform of operating a latch unit according to the present disclosure.

Please refer to FIG. 13, which shows a schematic waveform of operating a latch unit according to the present disclosure, and also refer to FIG. 10. In order to respond the light drive signal Vd with wider width (for example but not limited to 6 to 8 microsecond) as a latch signal for ending the signal recognition, a latch unit 57 is provided as shown in FIG. 10. The latch unit 57 is used to make end the signal recognition being correct to avoid too early turning off the oscillator 42 to cause the digital circuits to be out of order and malfunction. Moreover, in order to early turn off the oscillator 42 with relatively high power consumption to achieve low power consumption, the latch unit 57 having charging and discharging functions is proposed by a resistor-capacitor charging and discharging circuit, thereby replacing the timing function of the oscillator 42. As mentioned above, for the light drive signal Vd with 3-microsecond or 1-microsecodn cycle width (as shown in the first two cycle signals in FIG. 13). Since the first two cycle signals are not latching signals, a discharge voltage Vdis is greater than a predetermined latch voltage Vlatch, wherein the discharge voltage Vdis is provided by discharging operation through a capacitor of the latch unit 57. Alternatively, a charging operation of the capacitor of the latch unit 57 may be provided to achieve the similar determination. At this condition, a latch determine signal Slatch is low level, and the oscillator 42 can operate at low power in the eco mode and be turned off in the sleep mode, thereby implementing lower power consumption.

When the light drive signal Vd is the latching signal with 6-microsecond to 8-microsecond cycle width (as shown in the third cycle signal in FIG. 13), the discharge voltage Vdis is equal to or less than the latch voltage Vlatch at the time point t1 since the discharging time of the capacitor of the latch unit 57 is longer. At this condition, that latch determine signal Slatch is transited from the low level to the high level. Moreover, by continuously discharging the capacitor of the latch unit 57, it is to ensure that the light drive signal Vd as the latching signal to be normally detected and controlled after the oscillator 42 is turned off. Until the time point t2, since the output control switch Qsw is controlled to be turned on by the control unit CONR, the voltage level of the light drive signal Vd is restored. At this condition, since the voltage level of the light drive signal Vd is greater than the low-level voltage Vlow, the latch determine signal Slatch is transited from the high level to the low level, and therefore it is to leave the sleep mode and enter the work mode again in the next cycle.

However, the detection and control of the latching signal are not limited by comparing the discharge voltage Vdis with the latch voltage Vlatch. Alternatively, a predetermined time length is set for latching operation of the latch unit 57. For example, the latch unit 57 may be implemented by a timing circuit. Therefore, when the predetermined time length reaches or exceeds, the latching operation of the latch unit 57 is activated to meet the requirement of low power consumption.

In conclusion, the present disclosure has following features and advantages:

1. The data signal transmitted from the previous light string is enhanced (increased) by the signal converter and shaper to solve the problem of failing to identify or incorrectly determining the data signal received by the next light strings due to the signal attenuation caused by the signal transmission of long distance light strings.

2. By shortening the wiring distance between the data terminal and the LED light string, the control switch be driven by a sufficiently large control voltage regardless of the voltage decay affected due to the wire length so that the control switch can be normally turned on and turned off to ensure that the signal intensifier can normally operate.

3. In the same architecture, the light drive signal and the power supplying source are both transmitted to the LED light string.

4. The quick discharging circuit inside each of the LED modules is provided to quickly reduce the voltage level of the light drive signal to ensure that all in-series LEDs are completely controlled.

5. The simple application circuits are provided to solve determination abnormality and malfunction of the LED module since the light drive signal reduces to reach to the reset voltage.

6. It is to effectively reduce power consumption of the analogy circuits with relatively high power consumption and to make the LED module normally operate.

7. The LED module operates by the point control or by the synchronous control, and therefore to increase flexibility and convenience of designing the control circuit and implement diverse lighting effects and changes of the LED lamp.

8. The specific design of the oscillator is provided to implement the low-power oscillation, provide the clock signal, and ensure that the digital circuit can perform its necessary operation before the oscillator enters the sleep mode, thereby achieving the lower power consumption of the oscillator.

9. The charging and discharging time design and the predetermined time design of the latch unit ensure that the light drive signal as the latching signal to be normally detected and controlled, thereby achieving the lower power consumption of the oscillator.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. A cascading LED lights with low power consumption, comprising:

a master light string, comprising:

an LED light string having a plurality of LED modules, an output control switch coupled to the LED light string, and a controller coupled to the output control switch, and configured to receive a carry light signal and control the output control switch to drive the LED modules, at least one slave light string cascaded to the master light string, each slave light string comprising:

an LED light string having a plurality of LED modules, an output control switch coupled to the LED light string, and a signal intensifier coupled to the output control switch, and configured to receive the carry light signal and enhance the carry light signal, and control the output control switch to drive the LED modules, wherein when a voltage of the carry light signal is less than a low-level voltage, each of the LED modules enters a low-power-consumption mode.

2. The cascading LED lights with low power consumption in claim 1, wherein:

the master light string further comprises an output connector, wherein the output connector has a positive voltage terminal, a negative voltage terminal, and a data terminal, and the slave light string further comprises an input connector, wherein the input connected has two power pins and a data pin, wherein the two power pins are respectively coupled to the positive voltage terminal and the negative voltage terminal, and the data pin is coupled to the data terminal.

3. The cascading LED lights with low power consumption in claim 2, wherein the slave light string further comprises an output connector, wherein the output connected is coupled to the input connector of another slave light string.

4. The cascading LED lights with low power consumption in claim 1, wherein the signal intensifier comprises:

a control switch, and a signal converter and shaper coupled to the control switch, wherein when the control switch is turned on, the signal converter and shaper is configured to receive the carry light signal and enhance the carry light signal.

5. The cascading LED lights with low power consumption in claim 1, wherein the data terminal is coupled between the last LED module and the second last LED module.

6. The cascading LED lights with low power consumption in claim 1, wherein each LED module comprises a voltage comparison unit, wherein when the voltage of the carry light signal is less than the low-level voltage, the voltage comparison unit is configured to output a control signal to control each LED module entering a sleep state of the low-power-consumption mode.

7. The cascading LED lights with low power consumption in claim 1, wherein each LED module comprises a current detection unit, wherein when the voltage of the carry light signal is less than the low-level voltage, the current detection unit is configured to output a control signal to control each LED module entering an eco state of the low-power-consumption mode.

8. The cascading LED lights with low power consumption in claim 7, wherein within a time interval after entering the eco state of the low-power-consumption mode, each LED module is configured to perform the signal detection and the signal recognition; after the time interval, the control signal controls each LED module entering a sleep state of the low-power-consumption mode.

9. The cascading LED lights with low power consumption in claim 7, wherein each LED module further comprises an oscillator, wherein in the eco state of the low-power-consumption mode, the oscillator is configured to receive the control signal, and the oscillator is controlled by the control signal to be in an oscillation operation at low power.

10. The cascading LED lights with low power consumption in claim 7, wherein each LED module further comprises a latch unit and an oscillator, wherein in the eco state of the low-power-consumption mode, the latch unit and the oscillator receive the control signal, and the oscillator is controlled by the control signal to be disabled and the latch unit is controlled by the control signal to be in a timing operation.

11. The cascading LED lights with low power consumption in claim 10, wherein the latch unit is a charging and discharging circuit with a resistor and a capacitor.

12. The cascading LED lights with low power consumption in claim 10, wherein the latch unit is a timing circuit.

* * * * *